US006866067B2

(12) United States Patent
Lim et al.

(10) Patent No.: US 6,866,067 B2
(45) Date of Patent: Mar. 15, 2005

(54) MICRO CHANNEL UNIT

(75) Inventors: Seokhyun Lim, Seoul (KR); Haecheon Choi, Seoul (KR)

(73) Assignee: Seoul National University, Seoul (KR)

( * ) Notice: Subject to any disclaimer, the term of this patent is extended or adjusted under 35 U.S.C. 154(b) by 0 days.

(21) Appl. No.: 10/607,276

(22) Filed: Jun. 27, 2003

(65) Prior Publication Data

US 2004/0035481 A1 Feb. 26, 2004

(30) Foreign Application Priority Data

Aug. 23, 2002 (KR) ..... 2002-005128

(51) Int. Cl.[7] ..... F15B 21/00

(52) U.S. Cl. ..... 138/42; 138/37; 137/806; 137/833

(58) Field of Search ..... 138/37, 39, 38, 138/40, 42, 833, 806, 807; 137/833, 806, 807

(56) References Cited

U.S. PATENT DOCUMENTS 298,059 A * 5/1884 Bennett ..... 138/39
411,864 A * 10/1889 Leaycraft ..... 406/195
1,096,623 A * 5/1914 Girtanner ..... 406/153
1,786,882 A * 12/1930 Whitsitt et al. ..... 122/462
2,064,268 A * 12/1936 Parker ..... 138/42
2,194,946 A * 3/1940 Kunstorff ..... 137/177
2,200,788 A * 5/1940 Coy ..... 165/110
2,508,224 A * 5/1950 Carter ..... 138/42
3,685,534 A * 8/1972 Straitz, III ..... 137/171
3,760,874 A * 9/1973 Boskovic ..... 165/177
3,848,573 A * 11/1974 Phillips ..... 122/149
4,146,195 A * 3/1979 Brooks ..... 406/190
4,800,953 A * 1/1989 Veldhoff ..... 165/142
6,296,020 B1 * 10/2001 McNeely et al. ..... 137/806
6,375,901 B1 * 4/2002 Robotti et al. ..... 422/103
6,601,613 B2 * 8/2003 McNeely et al. ..... 137/833
6,725,882 B1 * 4/2004 Shia et al. ..... 137/827

OTHER PUBLICATIONS

Lim, S. & Choi, H. 2003, "Optimal Shape Design of Pressure–driven Curved Micro Channels with Hydrophilic and Hydrophobic Walls"; Nanotech 2003, San Francisco, CA USA, Feb. 23–27, 2003 (vol. 1, pp. 170–173).

Lim, S. & Choi. H. 2004; "Optimal Shape Design of a Pressure–driven Curved Micro Channel"; 42nd AIAA Aerospace and Sciences Meeting and Exhibit, Reno, NV USA, Jan. 5–8, 2004, AIAA–2004–624.

* cited by examiner

*Primary Examiner*—Patrick Brinson
(74) *Attorney, Agent, or Firm*—Rothwell, Figg, Ernst & Manbeck

(57) ABSTRACT

A micro channel unit having a shape designed to reduce a pressure drop when fluid passes through a connecting channel portion is provided. The micro channel unit includes a micro channel with a width of micrometer dimensions through which liquid flows. The micro channel includes a plurality of straight channel portions and connecting channel portions that connect each pair of adjacent straight channel portions. The connecting channel portions are wider than the straight channel portions connected by the connecting channel portions. The use of the micro channel unit can reduce the pressure drop when fluid passes through the connecting channel portions, thereby reducing the amount of power required to drive the fluid flow and further enabling miniaturization of microfluidic devices such as pumps and peripheral devices.

3 Claims, 7 Drawing Sheets

MICRO CHANNEL UNIT

BACKGROUND OF THE INVENTION

This application claims the priority of Korean Patent Application No. 2002-50128, filed on Aug. 23, 2002, the disclosure of which is incorporated herein in its entirety by reference.

1. Field of the Invention

The present invention relates to a micro-scale channel unit, and more particularly, to a micro channel unit having the shape of a connecting channel portion in order to reduce the pressure loss at a connection portion between adjacent straight channel portions in the channel unit.

2. Description of the Related Art

In recent days, micro-electromechanical systems (MEMS) are frequently used in the fields of life science, genetic engineering, disease diagnosis and new drug development for the detection and analysis of DNA or proteins, the measurement of micro volumes of vital metabolites and reactants, etc. As such, research on micro fluidic MEMS is a key factor to further miniaturize and improve the performance of existing analysis equipment.

For example, biochips used for new drug development and blood analysis include micro-scale channel units through which a fluid specimen to be analyzed passes. In this respect, it is desirable to make a channel in a micro-scale channel unit long enough to improve the performance of material extraction, chemical reactions, and mixing of substances.

However, micro channel units cannot accommodate only straight channels due to the miniature size of the biochip. To solve this problem, as shown in FIG. 8, connecting channel portions 120 and 130 curved at 90 and 180 degrees are used to connect adjacent straight channel portions 110, thereby providing long flow passages in the limited space of a micro channel unit 100. The widths of the connecting channel portions 120 and 130 are usually the same as those of the straight channel portions 110.

However, compared with a case where fluid passes through the straight channel portions 110, the fluid suffers much more pressure loss when it passes through the curved connecting channel portions 120 and 130. Also, the longer the channel becomes, the more pressure loss occurs. Therefore, more power to drive the fluid flow and so a relatively larger pump are required, which is undesirable for a miniaturized biochip.

Thus, it is of great importance to adequately design the connecting parts of the channel unit to reduce the fluid pressure loss.

SUMMARY OF THE INVENTION

The present invention provides a micro channel unit constructed to reduce a fluid pressure loss in connecting channel portions between adjacent straight channel portions.

In accordance with an aspect of the present invention, there is provided a micro channel unit including a micro channel with a width of micrometer dimensions, through which liquid flows. The micro channel includes a plurality of straight channel portions extending in a straight line pattern and the connecting channel portions that connect adjacent straight channel portions. Here, the connecting channel portions are wider than the straight channel portions.

In the micro channel according to the present invention, each connecting channel portion may become progressively wider from one of two adjacent straight channel portions connected by the connecting channel portion, toward the other straight channel portion, and is widest in a middle portion. Also, the connecting channel portion is smoothly curved.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
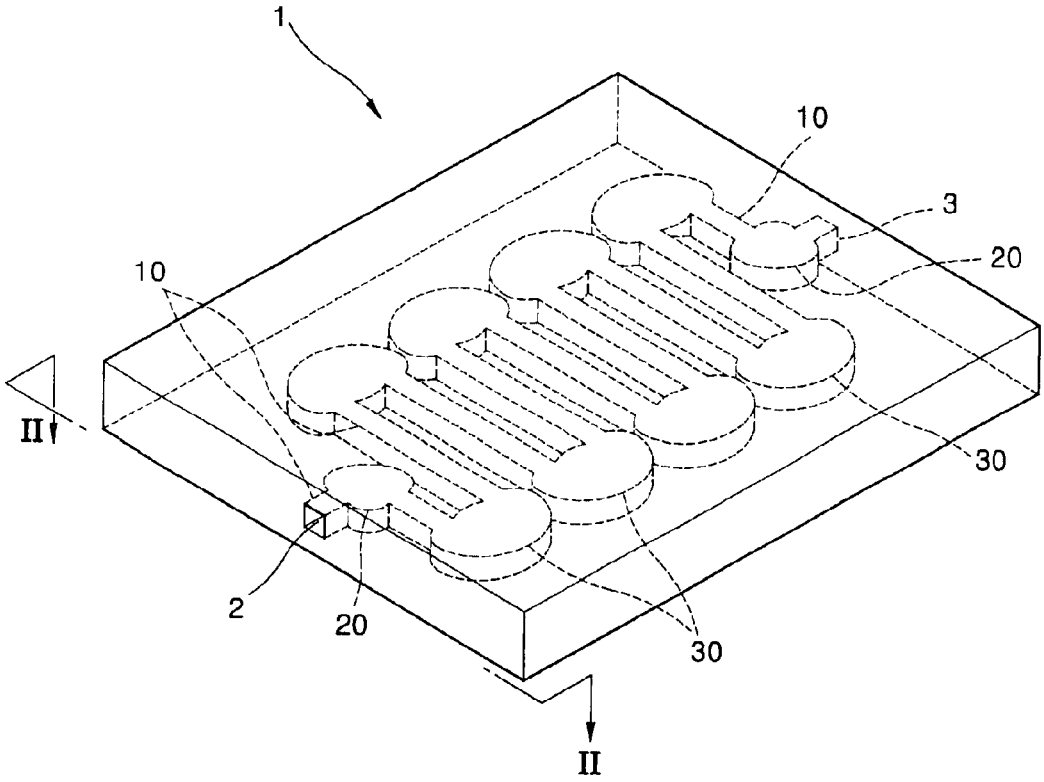
FIG. 1 is a schematic perspective view of a micro channel unit according to an embodiment of the present invention.
Figure 2:
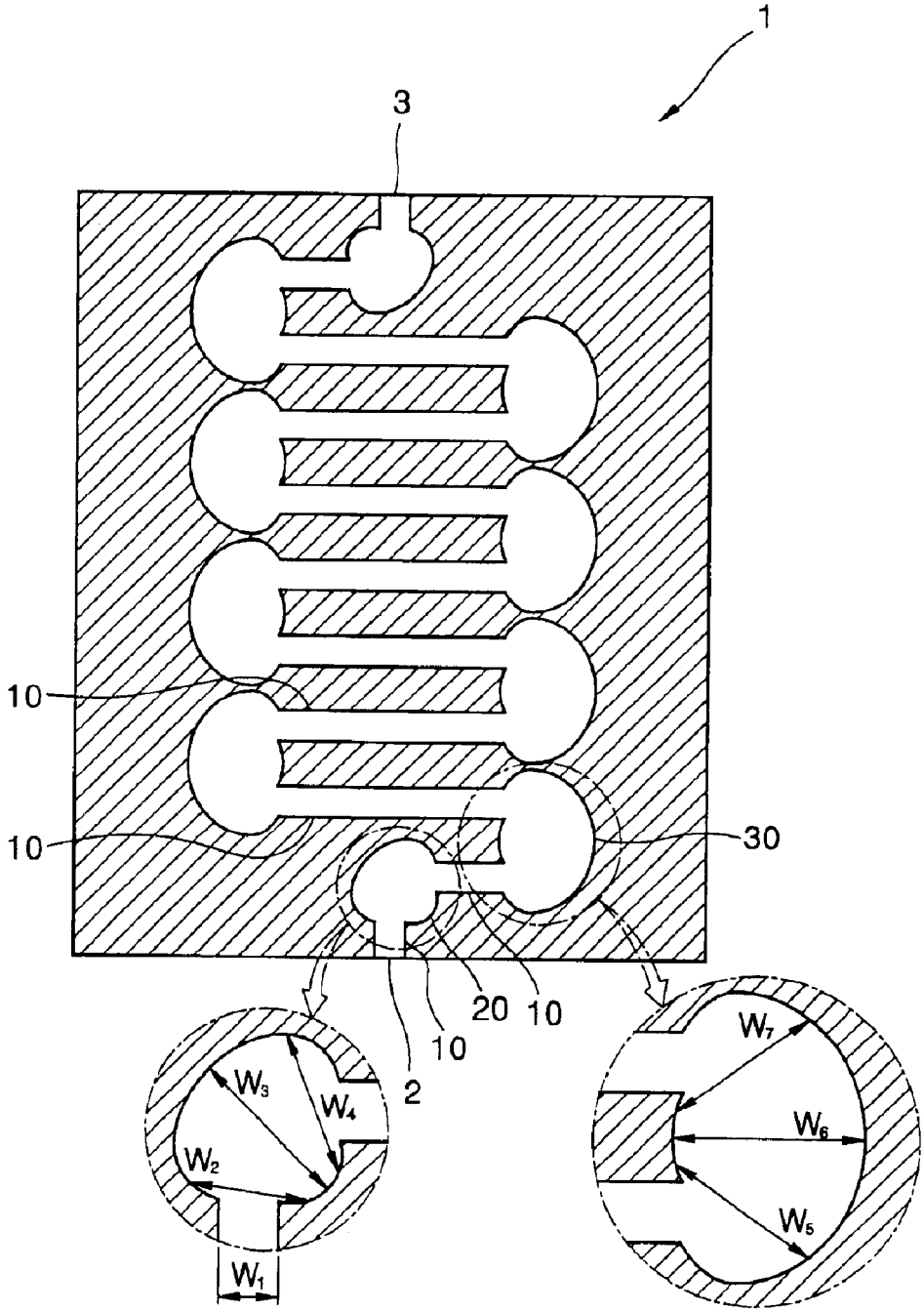
FIG. 2 is a cross-section of the micro channel unit taken along the line II—II in FIG. 1.
Figure 3:
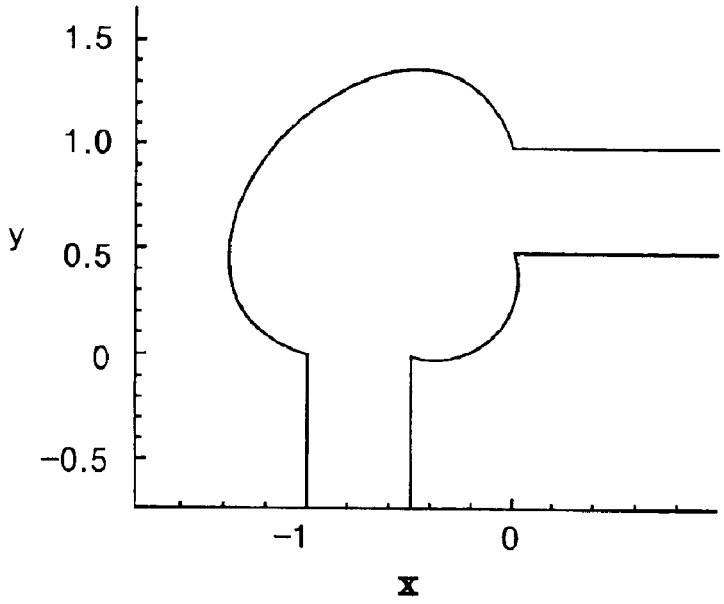
FIG. 3 is a graph illustrating an optimal shape of the connecting channel portion (curved at 90 degrees) shown in FIG. 1.
Figure 4:
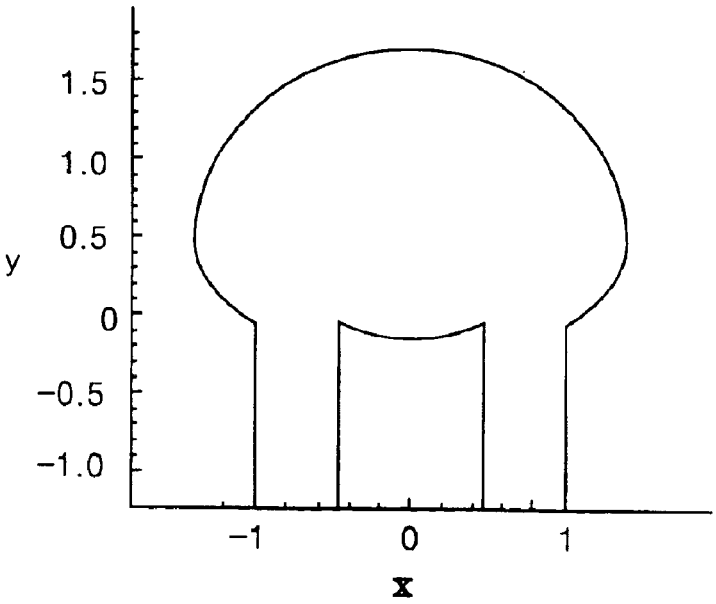
FIG. 4 is a graph illustrating an optimal shape of the connecting channel portion (curved at 180 degrees) shown in FIG. 1.

Referring to FIGS. 1 and 2, micro channels for liquid flow with the widths of micrometer-dimension are formed in a micro channel unit 1. The micro channel unit 1 includes a plurality of straight channel portions 10 extending in a straight line pattern, connecting channel portions 20 and 30 that connect pair of adjacent straight channel portions 10, the channel inlet 2, and the channel outlet 3.

The micro channel unit 1 may be formed in a substrate made of silicon or glass using dry etching and laser cutting methods. These methods are not only well known in the art but also not directly related to this invention, so a detailed description thereof will be omitted.

Figure 8:
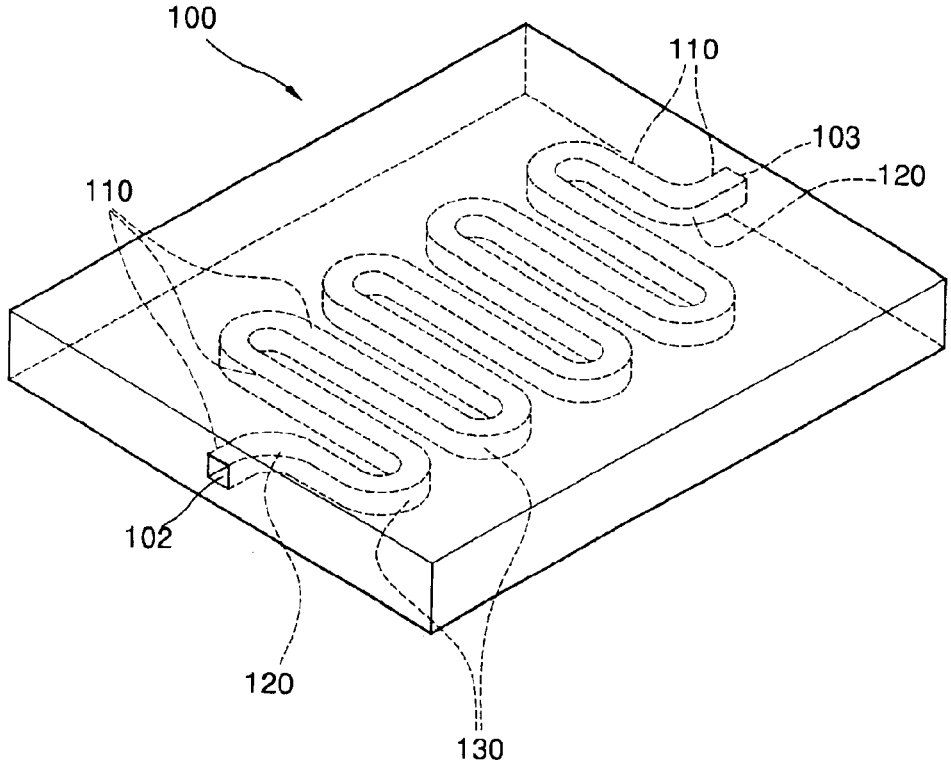
FIG. 8 is a schematic perspective view of a conventional micro channel unit.

Meanwhile, the micro channel unit 1 of the present invention is different from the conventional micro channel unit 100 described and shown with reference to FIG. 8 in the structure of the connecting channel portions 20 and 30. That is, while in the case of the conventional channel unit 100 shown in FIG. 8, the widths of the connecting channel portions 120 and 130 are the same as those of the straight channel portions 110 connected by the connecting channel portions 120 and 130, the widths of the connecting channel portions 20 and 30 are larger than those of the straight channel portions 10 in the case of the micro channel unit 1 according to this invention as shown in FIGS. 1 through 4.

In particular, in the micro channel unit 1, the connecting channel portion 20 or 30 becomes progressively wider from one of two adjacent straight channel potions 10 connected by the connecting channel portion 20 or 30, toward the other straight channel portion 10, and is widest in a middle portion.

Specifically, referring to FIG. 2, where reference character W denotes the width of the channel, in the case of the connecting channel portion 20 curved at 90 degrees, width $W_2$ at a portion adjacent to one of the two adjacent straight channel portions 10 is larger than width $W_1$ of the straight channel portion 10. Width $W_3$ in the middle of the connecting channel portion 20 is the largest among widths $W_1$, $W_2$, $W_3$, and $W_4$, and Width $W_4$ at a portion adjacent to the other straight channel portion 10, which is smaller than $W_3$, decreases to eventually be the same as the width $W_1$ of the other straight channel portion 10.

Similarly, in the case of the connecting channel portion 30 curved at 180 degrees, width $W_5$ at a portion adjacent to one of the two adjacent straight channel portions 10 is larger than the width of the straight channel portion 10. Width $W_6$ in the middle portion of the connecting channel portion 30 is the largest among widths $W_5$, $W_6$, and $W_7$. Width $W_7$ at a position adjacent to the other straight channel portion 10, which is smaller than $W_6$, decreases to eventually be the same as the width of the other straight channel portion 10.

The shape on either sidewall of the connection channel potion 20 or 30 is preferably curved so that friction force exerted on the wall is almost equal to zero. According to a well known optimal control theory, the curved shape on the sidewall of the connecting channel 20 or 30 can be optimized so that the frictional force between fluid flow in the connecting channel portion 20 or 30 and the wall of the connecting channel portion 20 or 30 becomes almost equal to zero. Thus, a pressure drop between both ends of the connecting channel portion 20 or 30 can be reduced as much as possible by optimizing the curved shape of the sidewall thereof.

Figure 5:
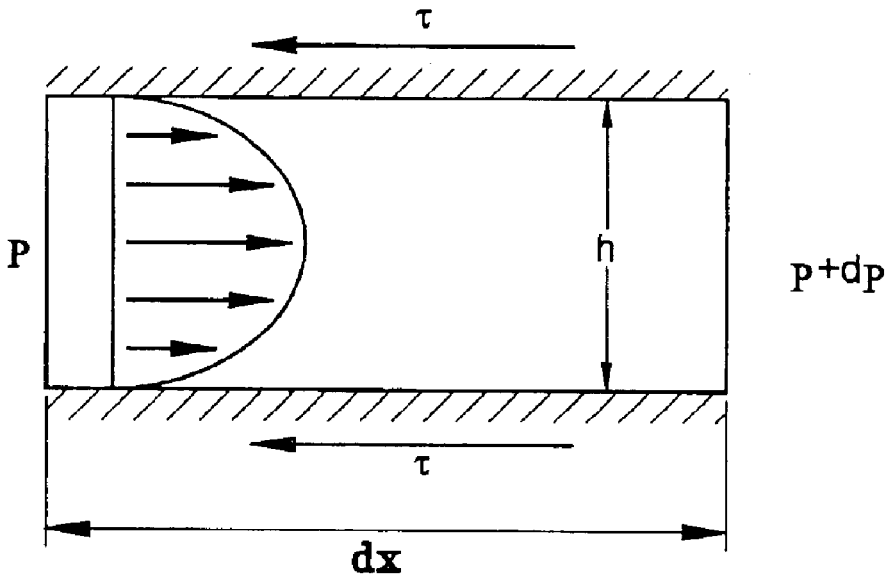
FIG. 5 is a schematic diagram showing a fully developed fluid flow in a connecting channel portion shown in FIG. 1.

To support this fact, referring to FIGS. 5–7, the state of the fluid flow is mainly dependent on the viscosity of the fluid. To cause the fluid to flow, power or a pressure difference that is large enough to overcome flow resistance due to the viscosity is needed. In FIG. 5, p, dp, $\tau$, and dx denote pressure, pressure difference, skin friction and streamwise distance, respectively. In case of fully developed flow of the fluid in the channel, the pressure difference equivalent to a sufficient amount of power to drive the fluid is proportional to the skin friction. That is, the relationship is given by the following equation:

$$-dp/dx=2\tau/h$$

where −dp/dx and h denote a pressure gradient in the streamwise direction and a channel width, respectively, and the negative sign (−) indicates a pressure drop in the streamwise direction.

If the widths of the connecting channel portions 20 and 30 are larger than the widths of the straight channel portions 10 as described above, the mean velocity of the flow decreases in the connecting channel portions 20 and 30 and the gradient of the velocity on the wall thereof decreases, thereby reducing the frictional force between the fluid and the wall. Thus, the pressure drop between both ends of the connecting channel portion 20 or 30 decreases so that it almost becomes equal to zero by reducing the skin friction $\tau$ on the wall to be nearly zero using the optimal control theory.

An example of an optimally shaped curved micro channel will be shown. In a biochip, blood or dilution of blood with water was used as a specimen fluid. The velocity (u) of the solution is normally 1–10 mm/s, the width (h) of a channel is about 100 $\mu$m, the kinetic viscosity (v) of the fluid is about $1\times10^{-6}$~$4\times10^{-6}$. Here, Reynolds number (Re) defined as Re=uh/v is about 0.1–1, which characterizes the flow in a micro channel.

Figure 6A:
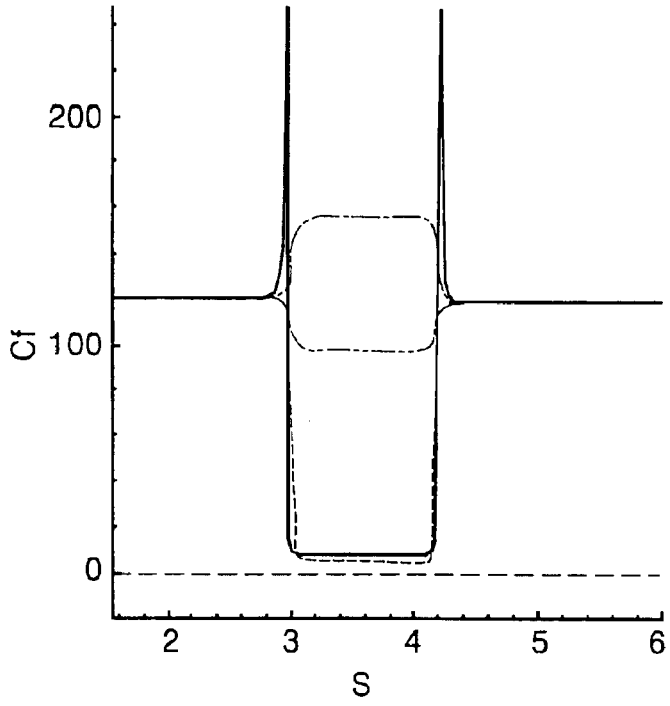
FIG. 6A is a graph showing the distributions of skin friction on the wall within a micro channel in the micro channel unit of FIG. 1, the connecting channel portion being curved at 90 degrees.
Figure 6B:
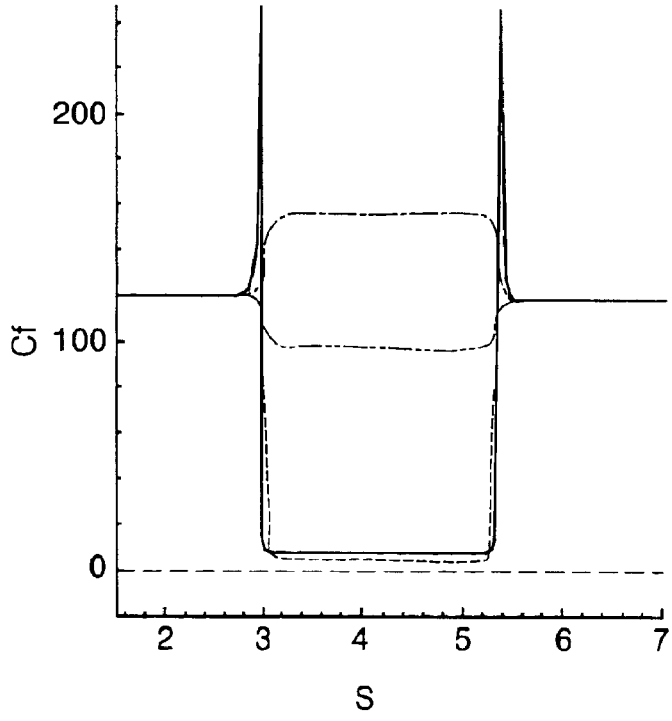
FIG. 6B is a graph showing the distributions of skin friction on the wall within a micro channel in the micro channel unit of FIG. 1, the connecting channel portion being curved at 180 degrees.

FIGS. 6A and 6B are graphs showing comparisons between the skin friction distributions along the walls of the micro channel unit 1 according to the present embodiment having the optimally-designed shape and those of the conventional micro channel unit 100 shown in FIG. 8. Here, $C_f$ and s denote the skin friction coefficient that means the skin friction force per unit area and the arc length along the wall. FIGS. 6A and 6B show the skin friction distributions on the wall within a micro channel, the connecting channel portion being curved at an angle of 90 and 180 degrees, respectively, for a Reynolds number of 1.

Skin friction distributions along the inner wall of the conventional micro channel unit 100 are indicated by dot-dashed lines, and skin friction distributions along the outer wall of the channel unit 100 are indicated by dot-dot-dashed lines. Skin friction distributions along the inner wall of the optimally-shaped micro channel unit 1 according to the present embodiment are indicated by solid lines, and skin friction distributions along the outer wall of the channel unit 1 are indicated by hidden lines.

Referring to FIG. 6A, the skin friction that is maintained constant when fluid flows in the straight channels varies when the arc length s ranges between 3 and 4.2 in the curved connecting channels. In the conventional micro channel unit 100, the skin friction increases on the inner wall of the connecting channel portion 120 and decreases on the outer wall of the connecting channel portion 120 due to the curvature effect of the shape.

In contrast, in the case of the micro channel unit 1 according to the present embodiment, the skin friction is nearly zero on both the inner and outer walls of the connecting channel portion 20, except at the connection points of s=3 and 4.2, where abrupt change in the skin friction occurs. Thus, based on the fact that the amount of power required to cause the fluid to flow is proportional to the skin friction, the power in the connecting channel portion 20 is significantly reduced as compared with power in the conventional connecting channel portion 120.

Similarly, this situation occurs in the connecting channel portion 30 curved at an angle of 180 degrees as shown in FIG. 6B.

Figure 7A:
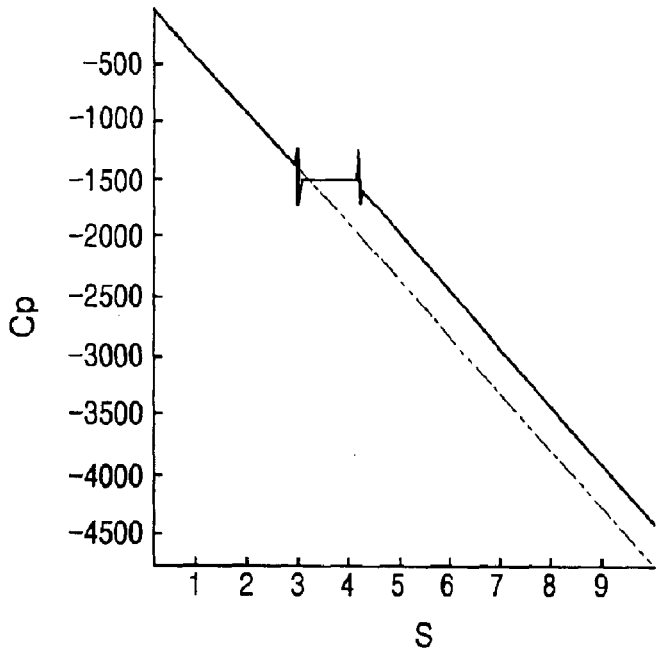
FIG. 7A is a graph showing the distribution of pressure on the wall within a micro channel in the micro channel unit of FIG. 1, the connecting channel portion being curved at 90 degrees.
Figure 7B:
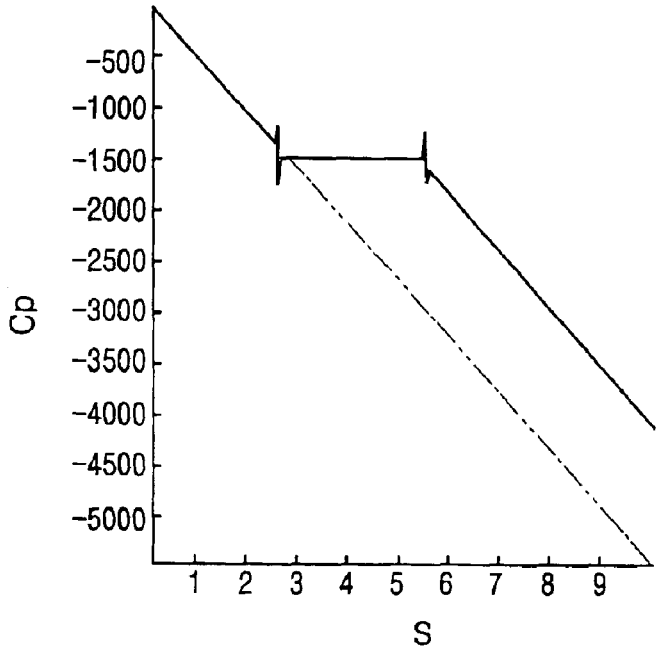
FIG. 7B is a graph showing the distribution of pressure on the wall within a micro channel in the micro channel unit of FIG. 1, the connecting channel portion being curved at 180 degrees.

FIGS. 7A and 7B are graphs showing pressure distributions as the fluid moves through 90- and 180-degree curved micro channels, respectively, where Cp denotes the pressure coefficient on the wall.

While pressure distributions along the inner wall of the conventional micro channel unit 100 are indicated by dot-dot-dashed lines, and pressure distributions along the inner wall of the channel unit 1 according to the present embodiment are indicated by solid lines. The pressure distributions along the outer walls are almost the same as the pressure distributions along the inner walls, so no indication has been made on the graphs.

It can be observed in FIGS. 7A and 7B that in the conventional micro channel unit, the pressure decreases almost linearly along the walls of the straight and curved channels. In contrast, in the case of the channel of the present embodiment, the pressure linearly decreases in the straight channels but remains nearly constant in the curved region wherein $3 \leqq s \leqq 4.2$ in the 90-degree curved channel (FIG. 7A), and wherein $3 \leqq s \leqq 5.2$ in the 180-degree curved channel, respectively (FIG. 7B), except at the connection points, where sharp change in the pressure occurs. That is, the pressure differences between both ends of the connecting channel portions 20 and 30 according to the present embodiment is significantly reduced compared with the conventional connecting channel portion by about 10–20%.

As is evident from FIGS. 7A and 7B, there is little fluid pressure loss in the connecting channel portions 20 and 30 according to the present invention, which means that the amount of power for driving the fluid flow is significantly reduced.

The connecting channel portions 20 and 30 are designed to have an optimal shape using the optimal control theory. Thus, a pressure drop that may occur at either end of the connecting channel portion can be significantly reduced by adopting similar shapes of connecting channel portions compared with the conventional connecting portions 120 and 130 having the same width as those of the straight portions 110, although they do not achieve the same effect as the connecting channel portions 20 and 30 in the present embodiment.

While this invention has been particularly shown and described with reference to a micro channel unit used in a biochip, it should not be construed as being limited to this embodiment. That is, this invention is applicable to various other fields where micro channel units are used.

As described above, a micro channel unit according to the present invention designed so that the connecting channel portion is wider than the straight channel portion can reduce the pressure drop when fluid passes through the connecting channel portion, thereby reducing the amount of power required to drive the fluid.

What is claimed is:

1. A micro channel unit comprising:

a micro channel with a width of micrometer dimensions through which liquid flows, the micro channel comprising:

a plurality of straight channel portions extending in a straight line pattern; and at least one connecting channel portions that connects each pair of adjacent straight channel portions, the connecting channel portions being wider than the straight channel portions connected by the connecting channel portions;

wherein the connecting channel is adapted to change flowing direction of the liquid in an angle in the range of 90 degrees to 180 degrees.

2. The micro channel unit of claim 1, wherein each connecting channel portion becomes progressively wider from one of two adjacent straight channel portions connected by the connecting channel portion, toward the other straight channel portion, and is widest in a middle portion.

3. The micro channel unit of claim 2, wherein the shape of the connecting channel portion is curved.

* * * * *